US007841592B2

(12) United States Patent
Wu et al.

(10) Patent No.: US 7,841,592 B2
(45) Date of Patent: Nov. 30, 2010

(54) PAPER FEEDING DEVICE

(75) Inventors: Shao-Yang Wu, Hsinchu (TW); Yueh-Shing Lee, Hsinchu (TW); Wen-Sheng Liu, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 302 days.

(21) Appl. No.: 12/103,494

(22) Filed: Apr. 15, 2008

(65) Prior Publication Data

US 2009/0256306 A1 Oct. 15, 2009

(51) Int. Cl.
*B65H 3/52* (2006.01)
*B65H 3/34* (2006.01)

(52) U.S. Cl. ..... 271/121; 271/167

(58) Field of Classification Search ..... 271/226, 271/131, 133, 165, 167, 121
See application file for complete search history.

(56) References Cited

U.S. PATENT DOCUMENTS

| | | | | | |
|---|---|---|---|---|---|
| 4,284,269 | A | * | 8/1981 | Ignatjev | 271/122 |
| 4,346,879 | A | * | 8/1982 | Ruenzi | 271/121 |
| 4,418,904 | A | * | 12/1983 | Fujimoto | 271/37 |
| 4,667,244 | A | * | 5/1987 | Ishikawa | 358/498 |
| 5,052,676 | A | * | 10/1991 | Shiina et al. | 271/121 |
| 5,335,902 | A | * | 8/1994 | Suzuki | 271/121 |
| 5,573,338 | A | | 11/1996 | Morikawa et al. | |
| 6,010,126 | A | * | 1/2000 | Mou et al. | 271/121 |
| 6,017,031 | A | * | 1/2000 | Oosawa et al. | 271/121 |
| 6,869,070 | B2 | * | 3/2005 | Shimamura et al. | 271/121 |
| 7,410,161 | B2 | * | 8/2008 | Yamamoto | 271/124 |

FOREIGN PATENT DOCUMENTS

| | | | | |
|---|---|---|---|---|
| JP | 57013032 | | * | 1/1982 |
| JP | 57013032 | A | * | 1/1982 |
| JP | 59043741 | | * | 3/1984 |
| JP | 59043741 | A | * | 3/1984 |
| JP | 60044433 | | * | 3/1985 |
| JP | 60044433 | A | * | 3/1985 |
| JP | 63262352 | | * | 10/1988 |
| JP | 63262352 | A | * | 10/1988 |

* cited by examiner

*Primary Examiner*—Stefanos Karmis
*Assistant Examiner*—Patrick Cicchino
(74) *Attorney, Agent, or Firm*—WPAT, P.C.; Anthony King

(57) ABSTRACT

A paper feeding device includes a pick roller, a spring element and a separator pad. The pick roller has a roller surface. The spring element is disposed above the pick roller. The spring element has two spring arms extending toward two ends of the pick roller. Free ends of the two spring arms extend to positions outside the two ends of the pick roller and below the roller surface so as to be contactless with the roller surface and are pushed forward and upward by papers and then transfer a press force to the pick roller. A separator pad is arranged in front of the spring element and contacts with the roller surface of the pick roller for cooperating with the pick roller to separate a lowermost one of the papers. Because the spring arms are contactless with the pick roller directly, so the spring arms do not rub the pick roller, which avoids the pick roller being abraded.

7 Claims, 6 Drawing Sheets

PAPER FEEDING DEVICE

BACKGROUND OF THE INVENTION

1. Field of the Invention

This present invention relates to a paper feeding device, and more particularly to a paper feeding device preferably applicable to an office device such as a printer, a copier and a scanner.

2. The Related Art

A conventional paper feeding device is generally used in various office devices such as a printer, a copier, a scanner and the like, it is highly desirable to feed single paper sheet from a stack of paper sheets placed at a paper feeding plate. There are many known prior paper feeding devices for single sheet feeding of paper.

A particular paper feeding device is disclosed in U.S. Pat. No. 5,573,338. In accordance with this patent, the paper feeding device includes a pick roller, a first spring element, a second spring element, a separator pad and a gate. The first spring element and the second spring element are disposed to contact with the pick roller at different positions in the conveying direction of the paper. The gate is provided between the first spring element and the second spring element to suppress the feed of papers. The separator pad is disposed to contact with the pick roller at the downstream side of the second spring element. In operation, the lowermost paper is in contact with the pick roller due to its own weight. As the pick roller rotates, plural pieces of papers will enter between the first spring element and the pick roller. Due to the action of the gate, the lowermost paper and several pieces of papers enter between the second spring element and the pick roller. And then only the lowermost paper can pass through the pick roller and the separator pad.

However, during the process of the paper feeding, the first spring element always presses on the pick roller, so the pick roller is prone to be abraded as the first spring element rubs it too much. In addition, the first spring element presses on the pick roller before the paper feeding device conveying papers to provide a prior press acting on the pick roller. The single paper needs a large enough push force to push the first spring element to insert between the first spring element and the pick roller, so when the push force acting on the single paper is not large enough, the paper feeding of single paper will be false.

SUMMARY OF THE INVENTION

Accordingly, an object of the invention is to provide a paper feeding device to reduce the abrasion of a pick roller and enhance the reliability of single paper feeding.

To achieve the object, the paper feeding device includes a pick roller, a spring element and a separator pad. The pick roller has a roller surface. The spring element is disposed above the pick roller. The spring element has two spring arms extending toward two ends of the pick roller. Free ends of the two spring arms extend to position outside the two ends of the pick roller and below the roller surface so as to be contactless with the roller surface and are pushed forward and upward by papers and then transfer a press force to the pick roller. The separator pad is arranged in front of the spring element and contacts with the roller surface of the pick roller for cooperating with the pick roller to separate a lowermost one of the papers.

According to another aspect of the present invention, the paper feeding device is provided to the present invention which also includes a pick roller, a spring element and a separator pad. The pick roller has a roller surface, and at least one annular gap is defined around the roller surface. The spring element is disposed above the pick roller. The spring element has at least one spring arm extending toward the pick roller, a free end of the spring arm extends into the annular gap so as to be contactless with the roller surface and lies below the roller surface for being pushed forward and upward by papers and then transferring a press force to the pick roller by papers. The separator pad is arranged in front of the spring element and contacts with the roller surface of the pick roller for cooperating with the pick roller to separate a lowermost one of the papers.

As described above, because the spring arm does not contact with the pick roller directly, the spring arm does not rub the pick roller, so the present invention can avoid the pick roller being abraded. Otherwise, no prior press acts on the spring arm, the paper is much easy to push the spring arm to enter between the spring arm and the pick roller, so the present invention enhances the reliability of single paper feeding.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
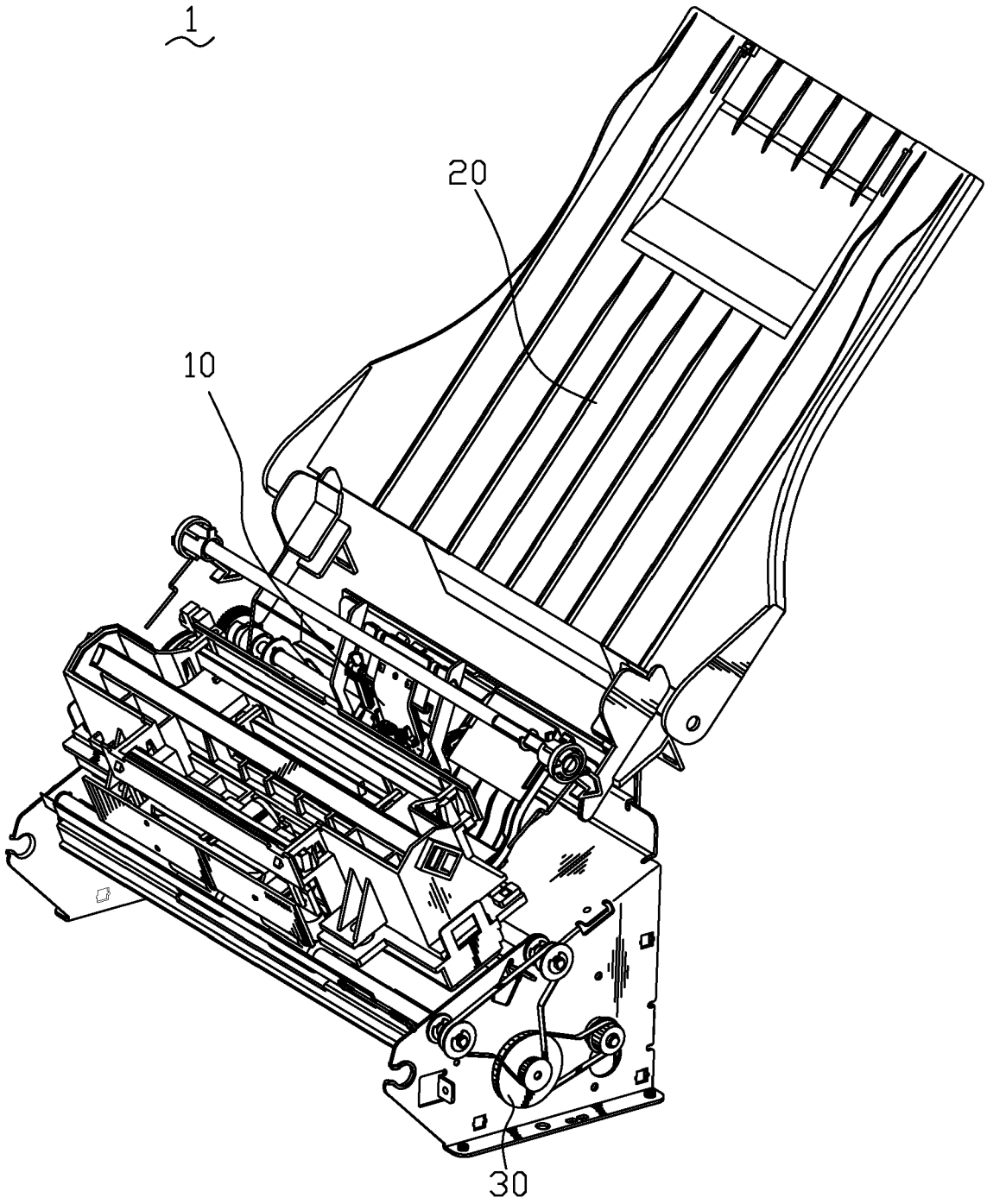
FIG. 1 is a perspective view of a paper feeding device disposed on a scanner according to a first embodiment of the present invention.

FIG. 1 is a view illustrating a first embodiment of the present invention. In this embodiment, the paper feeding device 10 is arranged on a scanner 1 which further includes a paper feeding tray 20 and a paper conveyer 30. A stack of papers (not shown) to be read is placed in the paper feeding tray 20, fed into the paper conveyer 30 by the paper feeding device 10, and then conveyed to a particular portion of the scanner 1 to read data by the paper conveyer 30. We define the conveying direction of the paper as the feeding direction of the paper, and define the feeding direction of the paper as a front direction.

Referring FIG. 2 to FIG. 5, the paper feeding device 10 includes a pick roller 100 having a roller surface 110, an upper frame 200, a bracket 300, a spring element 400, a press pad 500, a separator pad 600 and a restoration unit 700.

The bracket 300 placed above the pick roller 100 has a support board 310. A plurality of location pegs 311 vertically projects forward from proper places of the support board 310.

The bottom of the support board 310 extends and inclines rearward to form a prop board 320. Two ends of the support board 310 extend upward and downward to form two fixing portions 330 which are fixed on the upper frame 200.

The spring element 400 stamped from a metallic sheet has a holding portion 410. A plurality of first location holes 411 are opened in the holder portion 410 for mating with the location pegs 311 to fix the holder portion 410 on the support board 310 of the bracket 300. Two spring arms 420 extend from two ends of the top of the holding portion 410. The two spring arms 420 are respectively disposed outside two ends of the pick roller 100 in the axial direction of the pick roller 100. Each spring arm 420 has a clip portion 421 which extends and then bends downward and rearward from the top of the holding portion 410. The clip portion 421 clips the top of the support board 310. A free end of the clip portion 421 extends to form a spring portion 422 with a hooked tip bent forward. Free ends of the two spring portions 422 extend to positions outside the two ends of the pick roller 100 and are below the roller surface 110 so as to be contactless with the roller surface 110. The distance between the two spring arms 420 is larger than the length of the pick roller 100.

The press pad 500 has a pad holder 510 and a press portion 520 extending and inclining rearward from the bottom of the pad holder 510. The press portion 520 is placed in front of the spring arms 420 and against the front of the prop board 320 of the bracket 30. A plurality of second location holes 511 are opened in the pad holder 510 for mating with the location pegs 311 to fix the pad holder 510 on the support board 310 of the bracket 300. The tip of the press portion 520 is beyond the prop board 320 and faces the roller surface 110 of the pick roller 100. A small gap is formed between the tip of the press portion 520 and the pick roller 100.

The separator pad 600 is placed in front of the press pad 500. The friction coefficient of the separator pad 600 is larger than that of the papers and smaller than that of the pick roller 100. The separator pad 600 has a basic portion 610. A plurality of third location holes 611 are defined in the basic portion 610 for mating with the location pegs 311 to fix the basic portion 610 on the support board 310 of the bracket 300. A connect portion 620 extends and bends rearward from the tip of the basic portion 610. A separator portion 630 extends and bends forward from the tip of the connect portion 620 and contacts the roller surface 110 of the pick roller 100.

The restoration unit 700 includes a main body 710 and a spring 720. The main body has a base 711. A retaining rod 712 protrudes forward from the base 711. Two connecting rods 713 extend from two sides of the top of the base 711, and two pivots 714 respectively protrude outward from the two connecting rods 713 which are fixed on the upper frame 200. One end of the spring 720 surrounds the retaining rod 712 and resists on the base 711, and the other end of the spring 720 resists on the upper frame 200.

Figure 2:
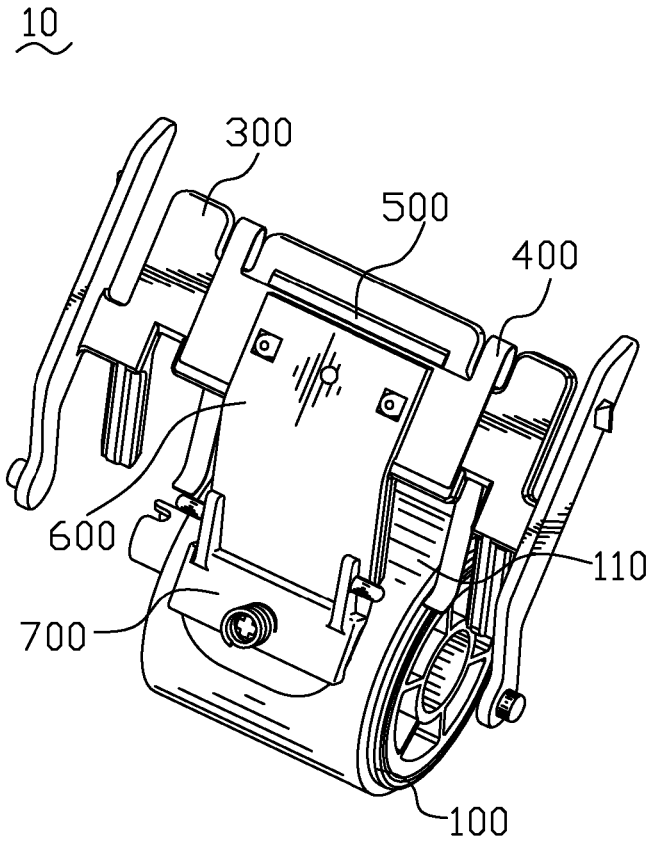
FIG. 2 is a perspective view of the paper feeding device without an upper frame.
Figure 3:
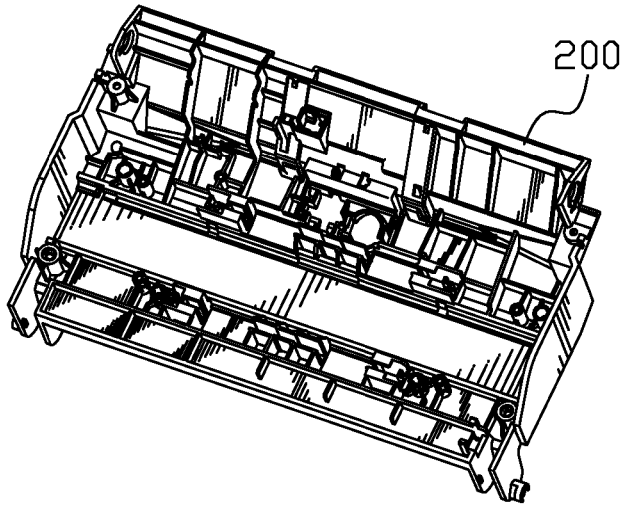
FIG. 3 is a perspective view of the upper frame of the paper feeding device.
Figure 4:
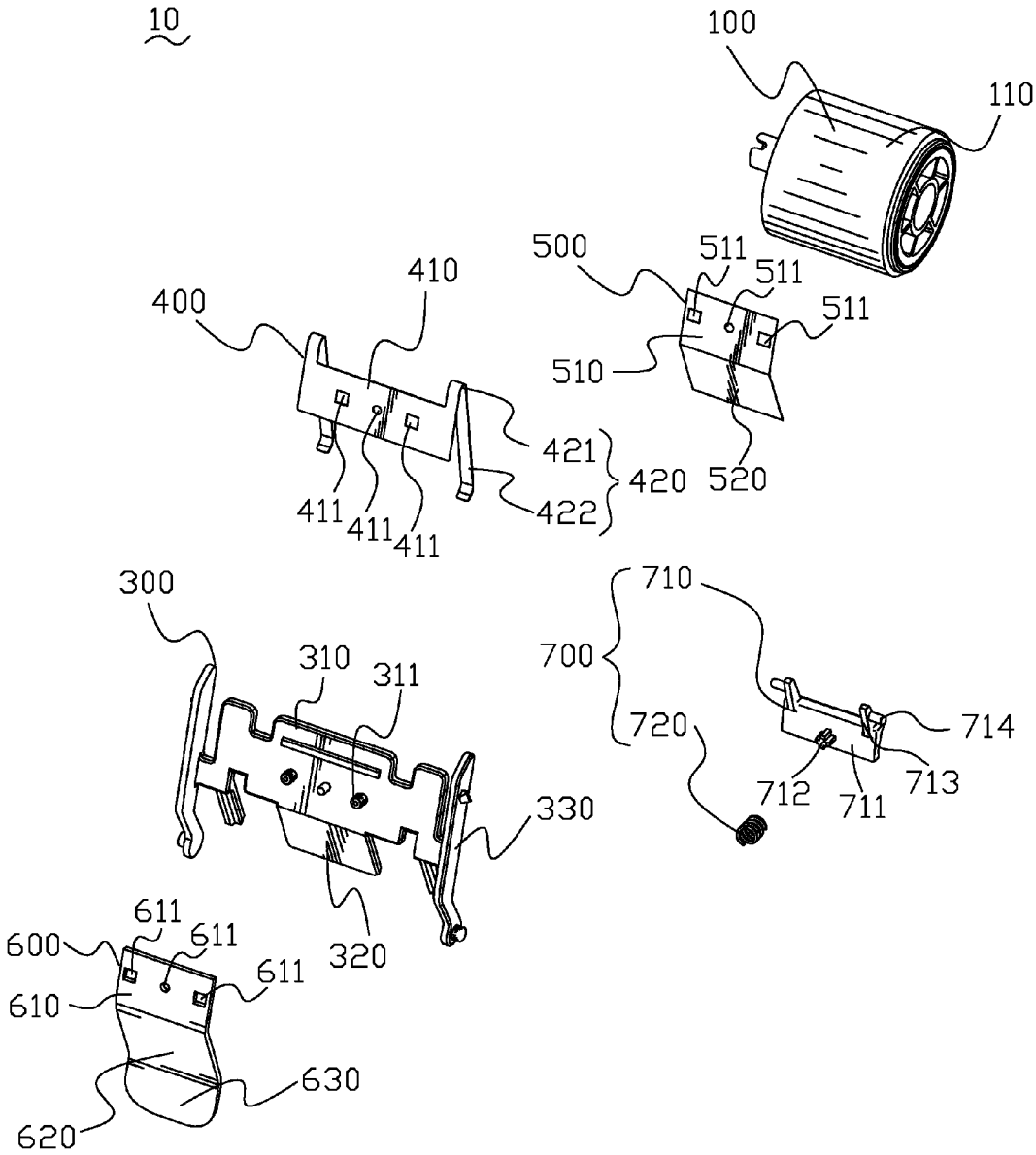
FIG. 4 is an exploded perspective view of the paper feeding device in FIG. 2.
Figure 5:
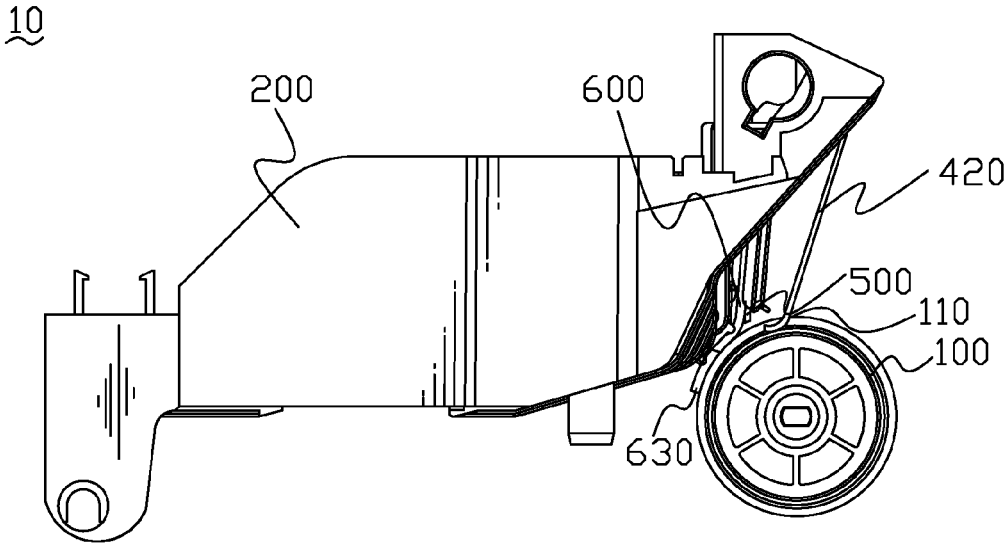
FIG. 5 is a lateral view of the paper feeding device.
Figure 6:
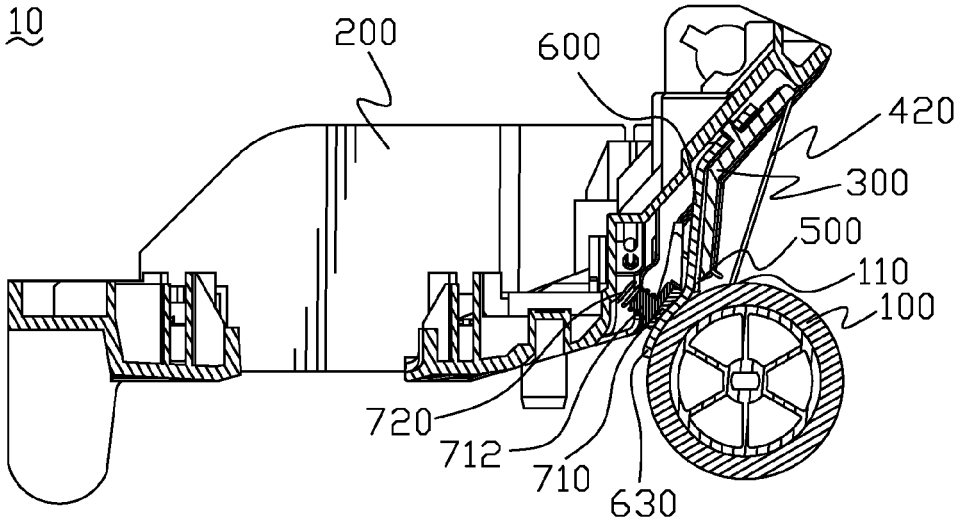
FIG. 6 is a cross-sectional view of the paper feeding device.

In FIGS. 1, 2 and 6, in operation, papers placed on the paper feeding tray 20 is drawn forward along with the rotation of the pick roller 10. As the spring arms 420 are positioned outside the two ends of the pick roller 100 and below the roller surface 110, leading ends of the papers firstly push forward the spring portions 422 of the spring arms 420 of the spring element 400. The tips of the spring portions 422 are pushed to the region above the pick roller 10. The papers will usually enter between the pick roller 100 and the spring arms 420. The spring arms 420 have a press on the papers which adds the friction between the lowermost paper and the pick roller 100, due to the action of the spring arms 420, the lowermost paper is conveyed forward with the rotation of the pick roller 100. So the spring arms 420 can feed the papers firstly.

The lowermost paper and several pieces of the papers thereon move to the separator portion 630 of the separator pad 600. The press portion 520 of the press pad 500 presses the papers to prevent them from curling. As the friction coefficient of the separator pad 600 is larger than that of the papers but smaller than that of the pick roller 100, the papers on the lowermost paper are prevented from entering to the position where the separator portion 630 is in contact, and only the lowermost paper passes through between the pick roller 100 and the separator portion 630. The paper entering into between the pick roller 100 and the separator portion 630 pushes the separator portion 630 upward, and at the same time the separator portion 630 pushes against the base 711 of the main body 710 of the restoration unit 700. The base 711 rotates upward around the pivots 714, and the base 711 pushes against the spring 720 to be compressed. After the paper is fed completely, the compressed spring 720 is released to press the base 711 to move downward, the base 711 further pushes the separator portion 630 to contact the pick roller 100 again for a next paper feeding.

According to the paper feeding device of the present invention as described above, the free ends of the spring portions 422 are below the roller surface 110 of the pick roller 100, the spring arms 420 plays a role of feeding the papers firstly. Because the spring arms 420 are not in direct contact with the pick roller 100, the spring arms 420 do not abrade the pick roller 100, so the present invention avoids the pick roller 100 being abraded. Furthermore there is no a prior press acting on the spring arms 420, the paper is much easier to push the spring arms 420 for entering into between the spring arms 420 and the pick roller 100 when feeding single paper even the paper has a small thickness. So the present invention can enhance the reliability of single paper feeding.

Figure 7:
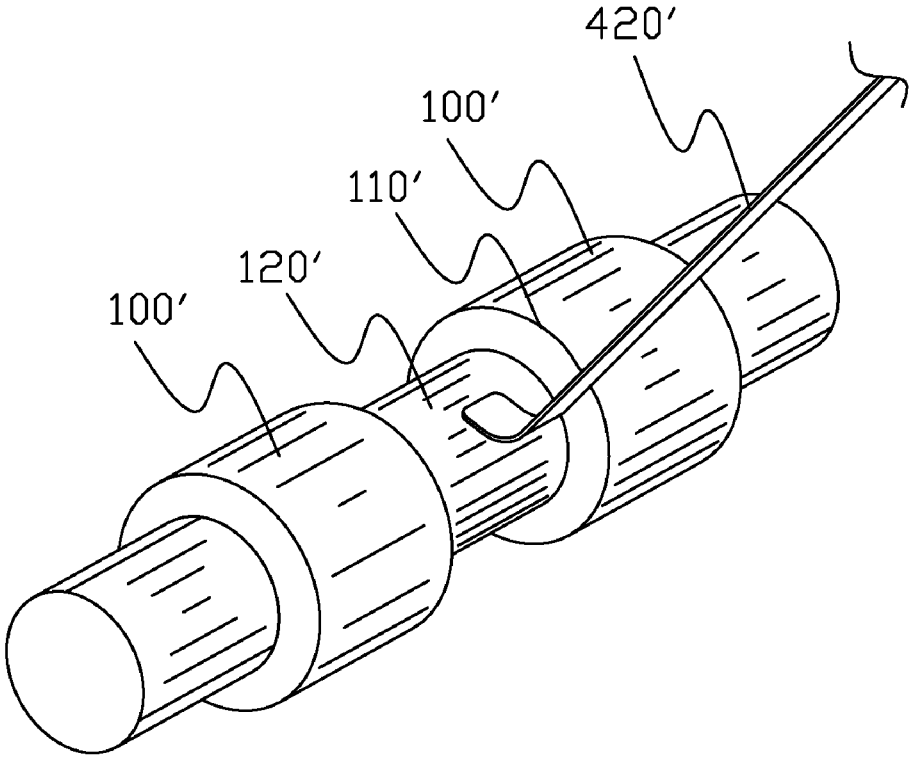
FIG. 7 is a perspective view of a spring element and a pick roller of the paper feeding device according to a second embodiment of the present invention.

FIG. 7 is a view illustrating a second embodiment of the present invention. This embodiment is similar to the first embodiment, and in this embodiment, the paper feeding device 10 includes a pick roller 100' having a roller surface 110'. An annular gap 120' is defined around the roller surface 110'. The annular gap 120' is defined in a middle portion of the roller surface 110' to equally divide the roller surface 110'. The spring element 400 has a spring arm 420'. A free end of the spring portion 420' extends into the annular gap 120' of the pick roller 100' so as to be contactless with the roller surface 110' and lies below the roller surface 110'.

Figure 8:
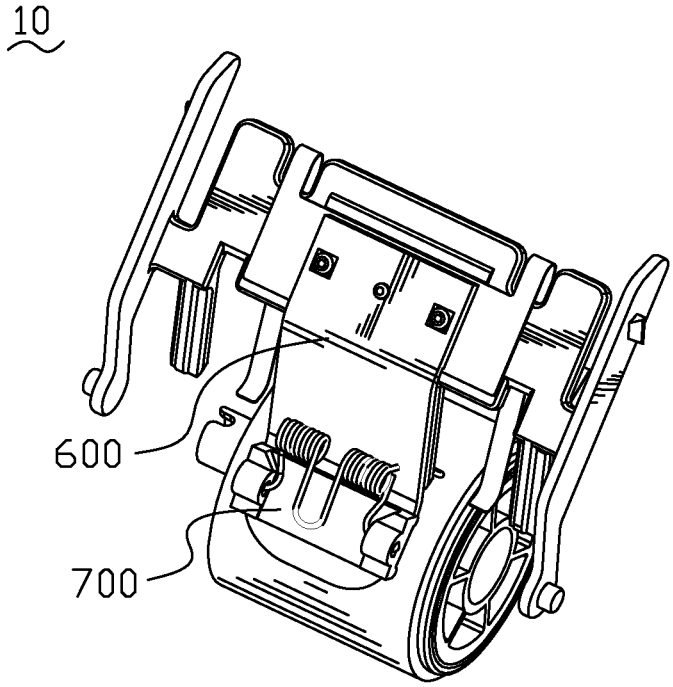
FIG. 8 is a perspective view of the paper feeding device according to a third embodiment of the present invention.
Figure 9:
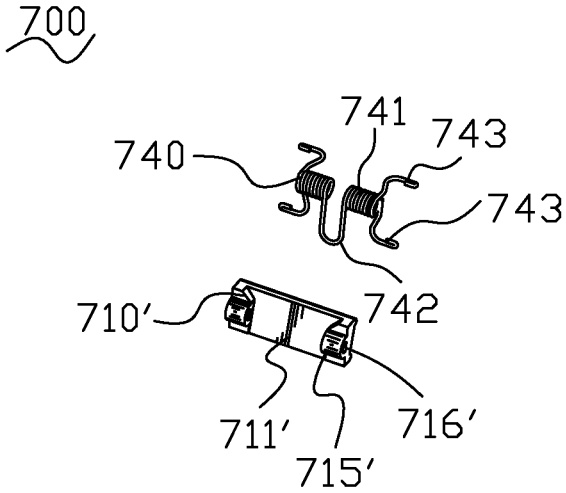
FIG. 9 is an exploded perspective view of a restoration unit of the paper feeding device according to the third embodiment in FIG. 8.

FIGS. 8 and 9 illustrates a third embodiment of the present invention. This embodiment is similar to the first embodiment. In this embodiment, the restoration unit 700 has a main body 710' disposed on the front of the separator portion 630 of the separator pad 600 and a torsion spring 740. The main body 710' has a base 711' showing a block shape and two axial portions 715' protruded forward from two ends of the base 711'. Each axial portion 715' has an axial hole 716' thereon. The torsion spring 740 arranged transversely has two torsion portions 741 showing a helical-shape and a U-shape contact portion 742 disposed between the two torsion portions 741. The contact portion 742 presses on the front of the main body 710'. The outer side of each torsion portion 740 extends oppositely to form two retaining arms 743, and one of the retaining arms 743 is fixed on the upper frame 200, the other of the retaining arms 743 is fixed in the axial hole 716' of the main body 710'.

In this embodiment, the paper entering into between the pick roller 100 and the separator portion 630 pushes the separator portion 630 upward, and at the same time the separator portion 630 pushes against the base 711' of the main body 710' of the restoration unit 700, the main body 710' moves upward with the separator portion 630. As the contact portion 620 presses on the main body 710' and the retaining arms 743 are fixed on the upper frame 200 and the axial holes 716' of the main body 710' respectively, so the torsion spring 740 will be distortion. After the paper is fed completely, the torsion spring 740 is released to press the main body 710' downward, and the main body 710' further pushes the separator portion 630 to contact the pick roller 100 again for a next paper feeding. As the torsion spring 740 is arranged transversely, which reduces the lengthways space and furthermore reduces the bulk of the paper feeding device 10.

Embodiments of the present invention have been discussed in detail. However, the embodiments are merely specific examples for clarifying the technical contents of the present invention and the present invention is not to be construed in a restricted sense as limited to the specific examples. Such modifications and variations that may be apparent to those skilled in the art are intended to be included within the scope of this invention as defined by the accompanying claims.

What is claimed is:

1. A paper feeding device, comprising:

a pick roller having a roller surface;

a spring element disposed above the pick roller, the spring element having two spring arms extending toward two ends of the pick roller, free ends of the two spring arms extending to positions outside the two ends of the pick roller and below the roller surface so as to be contactless with the roller surface and being pushed forward and upward by papers and then transferring a press force to the pick roller; and a separator pad arranged in front of the spring element and contacting with the roller surface of the pick roller for cooperating with the pick roller to separate a lowermost one of the papers, a bracket disposed above the pick roller, the bracket having a support board, the spring element having a holding board fixed on the support board, two sides of the holding board extending and bending downward to form the two spring arms;

wherein the spring arm has a clip portion extending upward and then bending downward and rearward from the holding portion, the clip portion clips the top of the support board, a free end of the clip portion extends downward further to form a spring portion placed on the rear of the support board, a free end of the spring portion extends downward and beyond the support board and then extends below the roller surface.

2. A paper feeding device, comprising:

a pick roller having a roller surface;

a spring element disposed above the pick roller, the spring element having two spring arms extending toward two ends of the pick roller, free ends of the two spring arms extending to positions outside the two ends of the pick roller and below the roller surface so as to be contactless with the roller surface and being pushed forward and upward by papers and then transferring a press force to the pick roller; and a separator pad arranged in front of the spring element and contacting with the roller surface of the pick roller for cooperating with the pick roller to separate a lowermost one of the papers, a bracket disposed above the pick roller, the bracket having a support board, the spring element having a holding board fixed on the support board, two sides of the holding board extending and bending downward to form the two spring arms;

wherein the paper feeding device further comprises a press pad having a pad holder and a press portion extending downward from the pad holder, the pad holder being fixed on the front of the support board of the bracket, the tip of the press portion maintaining a gap with the pick roller.

3. The paper feeding device as claimed in claim 2, wherein the support board of the bracket extends downward to form a prop board, the press portion of the press pad is against the front of the prop board, the tip of the press portion is beyond the prop board.

4. A paper feeding device, comprising:

a pick roller having a roller surface;

a spring element disposed above the pick roller, the spring element having two spring arms extending toward two ends of the pick roller, free ends of the two spring arms extending to positions outside the two ends of the pick roller and below the roller surface so as to be contactless with the roller surface and being pushed forward and upward by papers and then transferring a press force to the pick roller; and a separator pad arranged in front of the spring element and contacting with the roller surface of the pick roller for cooperating with the pick roller to separate a lowermost one of the papers, a bracket disposed above the pick roller, the bracket having a support board, the spring element having a holding board fixed on the support board, two sides of the holding board extending and bending downward to form the two spring arms;

wherein the separator pad has a basic portion, a connect portion extending and bending rearward from the tip of the basic portion, and a separator portion extending and bending forward from the tip of the connect portion, the basic portion is fixed on the support board of the bracket.

5. The paper feeding device as claimed in claim 4, further comprising an upper frame, the bracket being fixed on the upper frame.

6. The paper feeding device as claimed in claim 5, wherein two ends of the support board extend upward and then downward to form a fixing portion, the fixing portion is fixed on the upper frame.

7. The paper feeding device as claimed in claim 5, further comprising a restoration unit having a main body disposed on the front of the separator portion of the separator pad and a torsion spring, the torsion spring having two helical torsion portions arranged transversely and an U-shaped contact portion which presses on the front of the main body disposed between the two torsion portions, the outside of each of the torsion portions extending oppositely to defines two retaining arms, the two retaining arms being fixed on the upper frame and the main body respectively.

* * * * *